United States Patent [19]

Berger

[11] 3,991,413

[45] Nov. 9, 1976

[54] CONSTANT CURRENT DETECTOR SYSTEM

[76] Inventor: Philip H. Berger, 2250 Pheasant Way, Salt Lake City, Utah 84121

[22] Filed: June 23, 1975

[21] Appl. No.: 589,570

[52] U.S. Cl. ..... 340/267 R; 340/409; 340/421

[51] Int. Cl.[2] ..... G08B 21/00

[58] Field of Search ..... 340/267 R, 421, 220, 340/419, 248 A, 248 B, 248 C, 409, 213 R

[56] References Cited

UNITED STATES PATENTS

| | | | |
|---|---|---|---|
| 2,003,443 | 6/1935 | Henneberger | 340/213 R |
| 2,233,923 | 3/1941 | Maughmer | 340/267 R |
| 3,550,120 | 12/1970 | Kompelien | 340/409 |
| 3,603,949 | 9/1971 | Walthard | 340/409 |
| 3,832,678 | 8/1974 | Gysell et al. | 340/248 A |

*Primary Examiner*—Glen R. Swann, III
*Attorney, Agent, or Firm*—Trask & Britt

[57] ABSTRACT

A constant current generator supplies a constant current signal to a plurality of detector means via an output and ground return line. The detector means include an electrical resistance in series circuit in the output line and a sensor connected between the ground return line and the output line optionally subsequent in electrical circuit to the resistance. The sensor means becomes electrically conductive in the presence of a stimulus. As a result, the total resistance and in turn the voltage at the output of the constant current generator changes to a predictable value indicative of the identity of the conducting sensor. A detector circuit senses the change in voltage and sends a detection signal to activate operation means.

13 Claims, 4 Drawing Figures

CONSTANT CURRENT DETECTOR SYSTEM

BACKGROUND OF THE INVENTION

1. Field

This invention relates to detection systems and circuits. Specifically it provides for a system which detects a particular event or circumstance and causes the occurrence of a desired operation related to such detection. More specifically, it provides a system to detect the deroping of a cable from the grooved wheels on a cable tower of a chair lift system and indicate the location of the deroping and shut down the chair lift system upon deroping.

2. State of the Art

Detection systems such as those described in U.S. Pat. No. 2,871,466 (Vassil, et al.); U.S. Pat. No. 3,412,391 (Ward) and U.S. Pat. No. 3,594,740 (Comeau) typically employ voltage sources to supply an electrical signal having fixed voltage level to its sensing circuiry. The incidence of a stimulus (that which is to be detected) does not affect that voltage. Various electrical parameters (e.g., current) in the detecting circuitry are varied upon incidence of the stimulus and sensed to effect the operation desired (e.g., alarm).

Reliance on electrical parameters in the sensing circuitry suggests that such systems are limited to environments in which the ambient temperature is relatively constant absent the use of costly components and more components to adapt the system to a variable environment. Further, the use of a fixed voltage supply limits the amount of wiring between the voltage supply and the sensing circuity and in turn geographical distance therebetween because of the internal resistance of the wiring and the voltage drop experienced in the wiring. Further, such systems require the use of electrical components which differ from detector (sensing circuitry) to detector so that one detector is not interchangeable with another.

Chair lift systems of the type used to transport skiers to the top of a hill or mountain are well known. They are comprised of a plurality of intermediate towers to support a cable to which the chairs are attached. Each tower includes a cable transport and support device which is typically a grooved rotatable wheel, the cable fitting or riding in the groove. Should the cable jump out of the groove (deroping), a substantial hazard to people in the chairs would arise if the chair system movement is not immediately stopped.

Typical chair lift systems have a movable counterbalance weight to tension the cable with a safety system associated therewith to shut down the system when excessive counterbalance weight movement is detected. Upon deroping such movement might or might not occur, or if it occurs, it might occur too late in time to prevent harm to the people in the chairs.

SUMMARY OF THE INVENTION

The detection apparatus of the instant invention includes a power supply to supply electrical energy to a constant current generator. An output line and a ground line are connected to the constant current generator. A plurality of detector means are conductively connected to the output and ground lines. Each detector has a detector resistance in series circuit in the output line and a sensor means connected to shunt from the output line to the ground line. Upon the incidence of a stimulus, the sensor of a detector means becomes conductive shunting the current supplied on the output line to the ground line which in effect electrically eliminates all resistance subsequent in the output line electrical circuit. The voltage at the output of the constant current generator predictably changes in relation to the change in resistance. The detector circuit senses the voltage change and sends a detection signal to activate operation means which may be an alarm, visual/audio indicator, electro-mechanical indicator or the like.

In one embodiment a reference resistance is connected in series circuit subsequent to all detector means; and the sensor means are connected to the output line subsequent in electrical circuit to the detector resistance.

In another embodiment, the detector circuit contains means to detect the existance of an open-circuit condition electrically downstream from the output of the constant current generator. Open circuit locating means may be inclined to ascertain the location of the open-circuit. Bypass means may also be included to permit any one or more detector means to be electrically bypassed.

In yet another embodiment, the detector means are positioned proximate a cable and grooved wheel on the tower of chair lift system. Trip means are provided to shut down the chair lift system upon detection of a derope (cable unseated from grooved wheel) condition. Indicator means are also provided to indicate the location of the detector sensing the derope condition.

Other embodiments may include means to indicate the fact that detector means are bypassed and the identity thereof.

BRIEF DESCRIPTION OF THE DRAWINGS

In the drawings which illustrate what is presently regarded as the best mode for practicing the invention.

DESCRIPTION OF THE ILLUSTRATED EMBODIMENT

Figure 1:
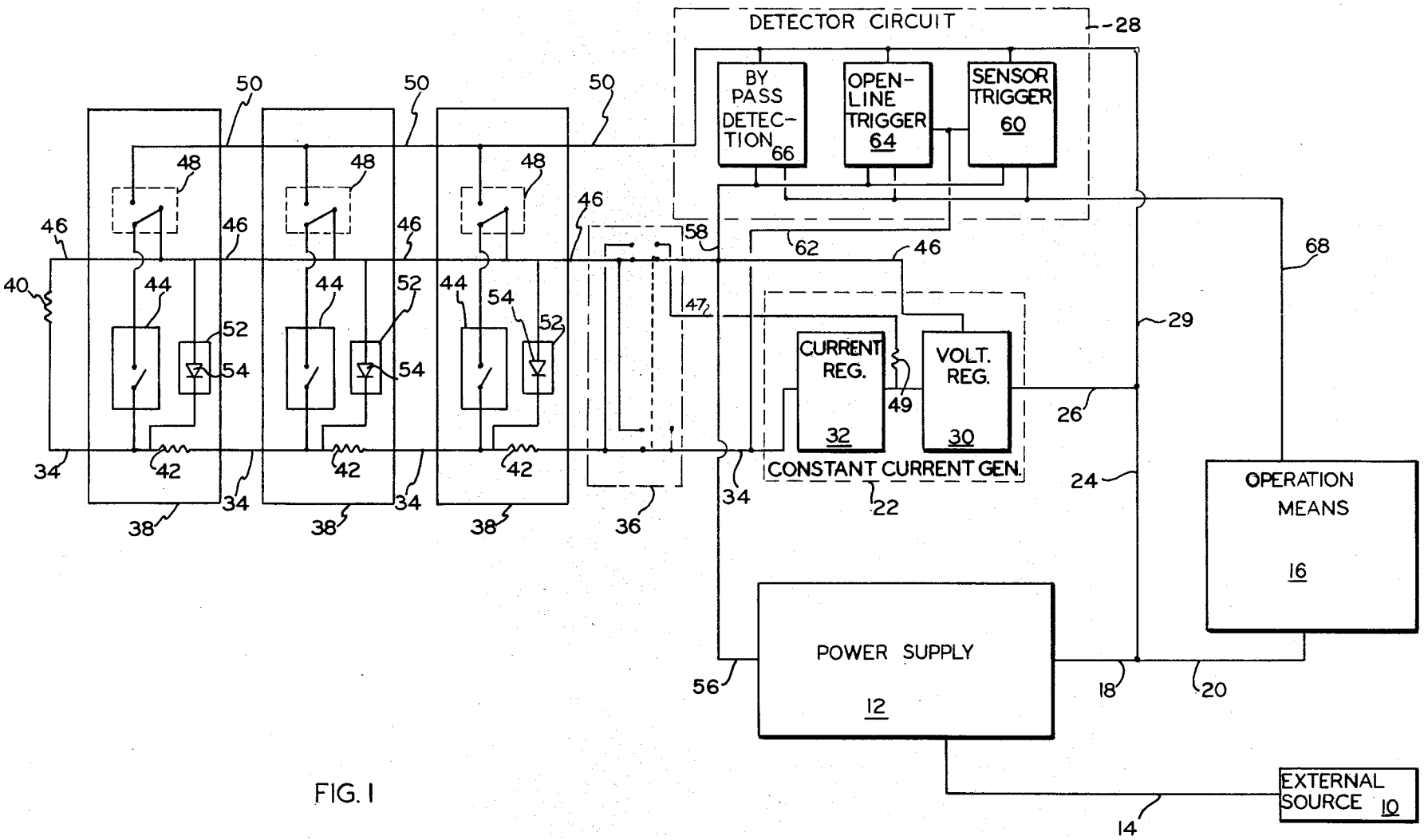
FIG. 1 is a simplified block diagram of a detector system of the invention.

As illustrated in FIG. 1, an external source 10 supplies electrical energy (e.g., 12 V DC) to the power supply 12 via conductor 14. The power supply 12 in turn supplies electrical power (1) to the operation means 16 over conductors 18 and 20, (2) to the constant current generator 22 over conductors 18, 24 and 26, and (3) to the detector circuit 28 over conductors 18, 24 and 29.

The constant current generator 22 is comprised of a voltage regulator 30 and current regulator 32. An output line 34 is connected to the regulator 32 to act as the output of the constant current generator 22. The output line 34 is connected to the open-circuit locating means 36. The open-circuit locating means 36 as here illustrated, is a ganged push button switch. Those skilled in the art will recognize that other means may be employed to accomplish the switching function ascribed to the open-circuit locating means 36.

The output line 34 is further connected to a plurality of detector means 38 and a reference resistance 40. The detector means 38 each include a detector reference resistance 42 connected in series circuit in the output line 34. Each detector has sensor means 44 connected between the output line 34 and the ground line 46. The sensor means 44 as here illustrated, is a single-pole, single-throw switch to show that the sensor means 44 has a nonconductive (switch open) state and a conductive (switch closed) state. The sensor means 44 may be a push button, a magnetic induction switch or any other device which can respond to a stimulus by changing from a nonconductive to a conductive state either by itself or in combination with other circuitry as exemplified in FIG. 4 hereinafter discussed.

The detector means 38 also includes a bypass switch 48 which is illustrated as a double-pole, single-throw switch. It is shown connecting the sensor means 44 to the ground line 46. To electrically bypass the detector means 38, the connection to the ground line 46 from the sensor means 44 is interrupted by opening the switch 48. In the illustrated version, the switch 48 is placed in a bypass condition by connecting the ground line 46 to a bypass conductor 50 which is connected to the detector circuit 28.

The detector means 38 may also include circuit means 52 which inhibits the flow of current from the output line 34 to the ground line 46 while permitting the flow of current from the ground line to the output line 34. As here illustrated, a blocking diode 54 is used. It may also be noted that the electrical components and circuitry of each detector 38 are virtually the same so that the detectors are readily interchangeble.

The reference resistance 40 is connected between the output line 34 and the ground line 46 preferably subsequent in electrical circuit to the detector means 38. The ground line 46 and output line 34 may be connected after the last detector means 38 with the sensor means 44 being connected prior in electrical circuit to the resistance 42. In that event, a separate reference resistor could be installed at the output of the generator 22; or the internal resistance of the generator 22 may be used as the reference resistance. The ground line 46, which is a common electrical ground, returns to the current generator 22. The power supply 12 and detector circuit 28 are connected to the ground line 46 via conductors 56 and 58, respectively.

The detector circuit 28 has a sensor trigger 60 which has as an input the voltage across the output of the constant current generator 22. The ground conductor 58 and conductor 62 connect to the ground line 46 and output line 34, respectively, to provide the input.

The detector circuit 28 may also include an open-line trigger 64 and a bypass detection circuit 66. The open-line trigger 64 also receives the voltage at the output of the constant current generator 22 via conductors 58 and 62. The bypass detection circuit 66 receives an input from the ground line 46 via conductor 58 and from the bypass conductor 50. The detection circuit 28 output, which is comprised of detection signals generated by the sensor trigger 60, open-line trigger 64 and bypass detection circuit 66, is supplied to the operation means 16 via conductor 68.

In operation, the constant current generator 22 supplies constant current to the output line 34. A voltage appears at the generator output reflective of the total resistance in the output line 34. The total resistance will be the sum of all the resistances in circuit.

That is, it will be the sum of all the detector electrical resistances 42 and the reference resistance 40. The voltage resulting can readily be determined by use of the well-known relationship of E=IR where E represents voltage, I represents current and R represents resistance.

Upon the incidence of a stimulus, the sensor means 44 becomes conductive and in effect shunts out all resistance in the output line 34 downstream (subsequent in electrical circuit) of the conducting sensor means 44. The total resistance in circuit thereby changes (diminishes). The voltage at the output of the constant current generator 22 also changes based on the E=IR relationshipj. The change is predictable because the detector electrical resistance 42 and the reference resistance 40 are preselected in value to produce a predictable voltage at the output of the constant current generator 22 which reflects not only the fact of sensor 44 stimulation but also the identity of the stimulated sensor 44. The sensor trigger 60 of the detector circuit 28 detects the voltage change upon sensor stimulation and sends a detection signal to the operation means 16. The operation means 16 may be an audio/visual alarm or any device or apparatus provided to accept the detection signal.

In the event of an open-circuit condition anywhere in the circuit comprised of the output line 34 and ground line 46, the voltage appearing at the output of the constant current generator 22 will change to a voltage limited only by the internal resistance of the generator 22. That is, no resistance from the output line will be in circuit. The internal resistance of the generator 22 is very large in relation to the total resistance in circuit at any time. Thus, with the relationship of E=IR, it can be seen that the voltage will markedly increase. The open-line trigger 64 detects the voltage condition and sends a detection signal to the operation means 16.

A preferred feature of the invention incorporated in the embodiment illustrated in FIG. 1, allows for the determination of the location of an open-circuit condition. Open circuit locating means 36 are connected in the ground line 46 and output line 34. Actuation of the locating means 36 (as here illustrated, the operation of the depicted switch) causes the output line 34 and ground line to reverse so that the voltage generator 30 output is supplied to the ground line 46 via conductor 47 and dropping resistor 49. Current flows from the ground line 46 through the circuit means 52 to the output line 34. The detector electrical resistances 42 are thus in circuit for all detectors 38 up to the point of the open circuit. All detector electrical resistance 42 and/or the reference resistance 40 downstream electrically from the open-circuit will not be reflected. Using the E=IR relationship, it can be seen that the location of the open circuit can be determined because the resulting voltage drop across reference resistor 49 is predictable. The voltage drop across resistor 49 may be sensed by the detector circuit 28 which sends a signal to the operation means 16 reflecting the location of the open circuit.

In operation, it may be necessary to bypass a detector means 38 due to a malfunction or for other reasons. To bypass a detector means, the bypass switch 48 need be operated only to open the circuit and interrupt the connection of the sensor means 44 to the output line 34 or the ground line 46. In some applications, it may be preferred or desirable to detect the existence of a bypass condition. As illustrated in FIG. 1, the bypass switch 48 can be operated to connect to a bypass conductor 50. As a result a completed circuit is made between the conductor 50 and the ground line 46 which is detected by the bypass condition circuit 66 in the detector circuit 28. Upon sensing the operation of a bypass switch 48, a detection signal is sent to the operation means 16.

Figure 2:
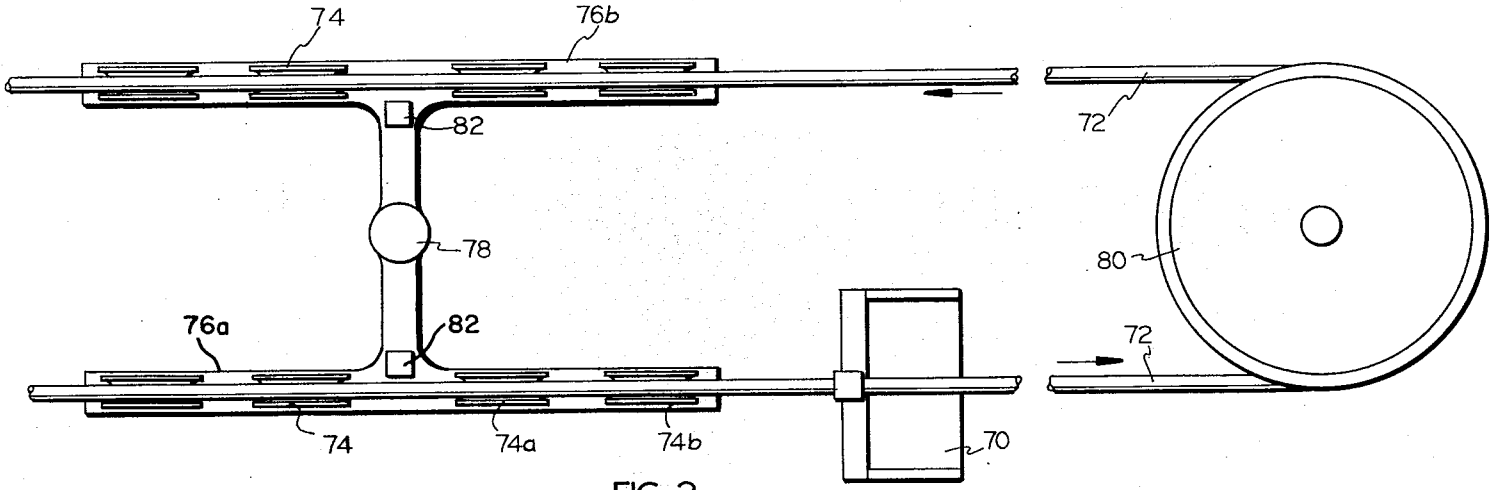
FIG. 2 is a simplified top view of a portion of a chair lift system.

Referring now to FIG. 2, a simplified view of a portion of a chair lift system is illustrated. Chairs 70 which are adapted to carry people are suspended from a cable 72. The cable 72 is supported by grooved wheels 74 rotatably positioned on arms 76*a*, 76*b* of a cable tower 78. The cable 72 is formed into a continuous loop and driven by a powered horizontal wheel 80. It is possible, in most systems, for the cable 72 to jump out of the grooves of the wheels 74 (i.e., derope). Continued movement of the cable 72 would potentially allow the cable to completely disengage at the tower 78 with the concomitant catastrophic result as to the people in the chairs and/or to the system itself. One or more detector means 82 may be positioned proximate the wheels 74 and cable 72 to detect cable 72 deroping and cause the chair lift system to shut down.

Figure 4:
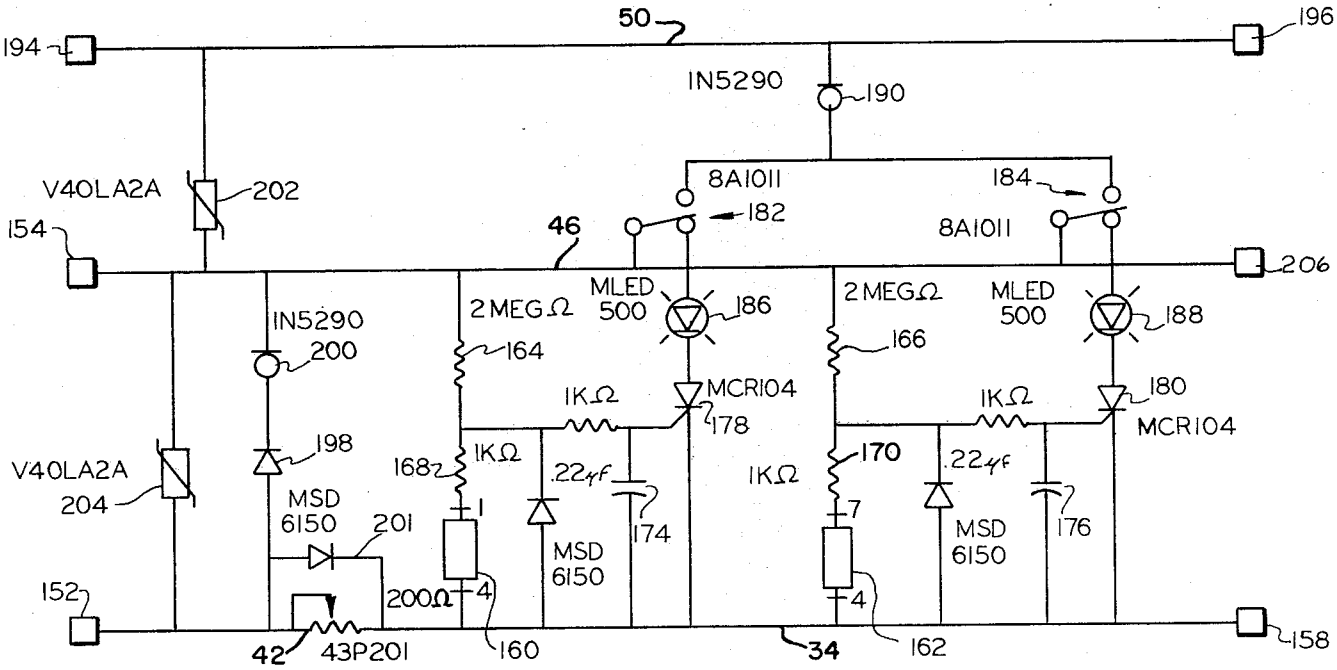
FIG. 4 is a practical circuit diagram of a detector means for use with the circuit of FIG. 3 and the system of FIG. 2.
Figure 3:
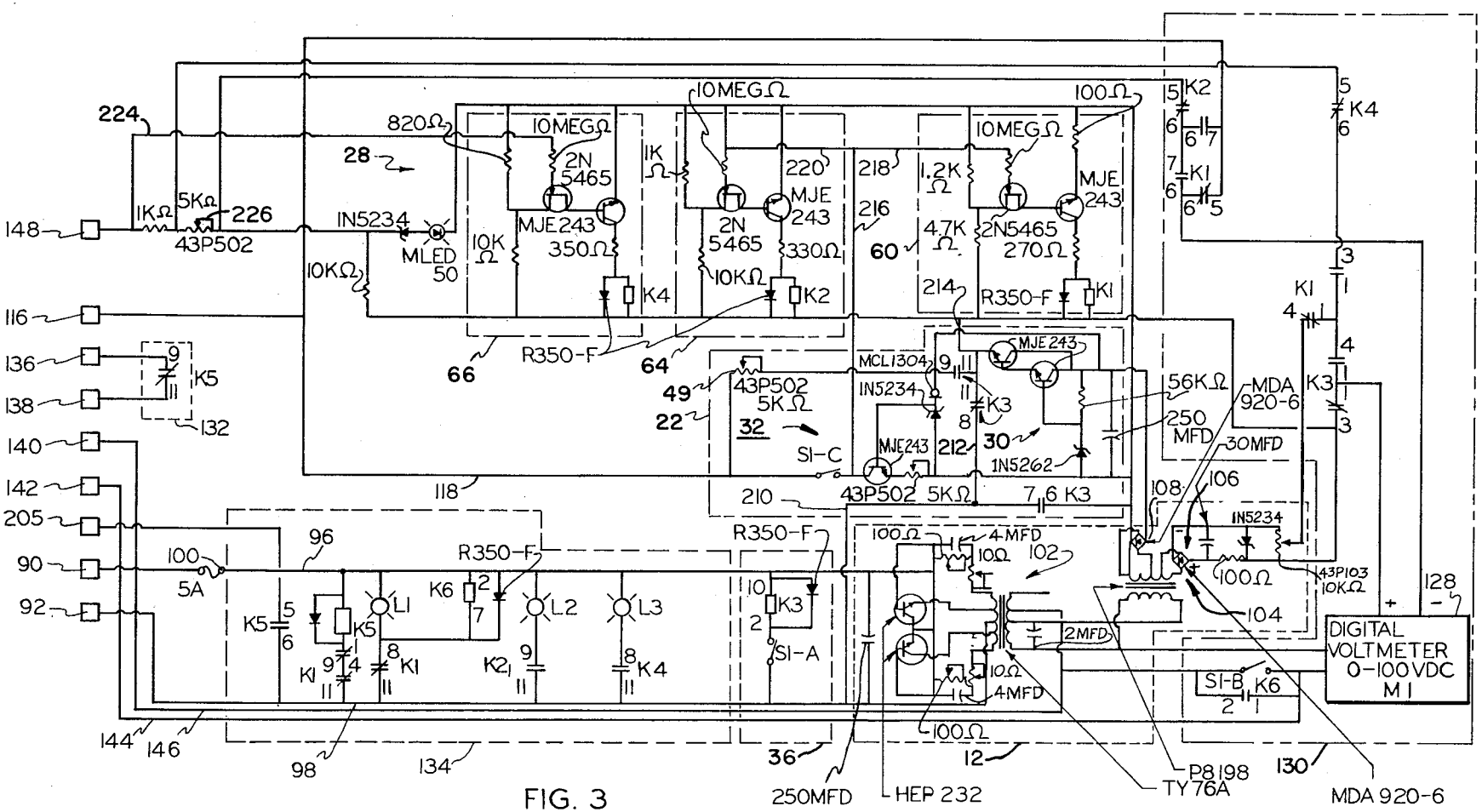
FIG. 3 is a practical circuit diagram of a portion of a detector system of FIG. 1 adapted for use with the chair lift system of FIG. 2.

FIGS. 3 and 4 illustrate practical circuitry embodying the principles of the invention which are adapted for use with the chair lift system illustrated in FIG. 2. Referring in particular to FIG. 3, power from an external source (i.e., 12 V DC) is received at terminal 90 with respect to the ground terminal 92. The power is transmitted to the power supply 12 via conductors 96 and 98. Fuse 100 is positioned in the line to provide overload protection for the circuitry. An inverter generally numbered 102 inverts the 12 V DC into a 110 V AC signal having generally square wave characteristics and supplies the AC signal to a rectifier circuit generally numbered 104. The rectifier circuit 104 is comprised of rectifier 106 and 108. Rectifier 106 is a 6 volt power supply; and rectifier 108 is a 51 volt power supply to the constant current generator 22. Rectifier 104 supplies about a 2 volt bias signal to the meter 128 for zeroing purposes.

The constant current generator 22 is comprised of a voltage regulator and a current generator generally numbered 30 and 32, respectively. The regulator 30 is a Darlington array. The output of the constant current generator 110 is supplied to terminal 116 via conductor 118 for further connection to the detector means of FIG. 4.

The detection means, generally numbered 28, includes a bypass detection circuit 66, an open line trigger 64 and a sensor trigger 60. The operation means as here illustrated, includes the voltmeter 128 and relay circuitry 130, the trip circuit 132, and the relay and indicator circuitry 134. The trip circuit 132 is a relay contact circuit connected in the electrical power supply or control circuit of the chair lift system (FIG. 2) through contacts 136 and 138 to interrupt the power to the chair lift system and shut it down upon the existence of a detection signal as hereinbefore and hereinafter discussed. The relay and indicator circuits 134 operate in cooperation with the circuitry 130 to provide for indications and operations as hereinafter discussed.

Contacts 140 and 142 are connected through a meter on-off switch to supply power via conductors 144 and 146, directly to the meter 128. Contact 148 is connected to the detector means (FIG. 4), as more fully discussed hereinafter.

Referring now to FIG. 4, the output of the constant current generator 22 is received from terminal 116 (FIG. 3) at terminal 152. The ground line at terminal 92 is connected to terminal 154. As here illustrated, the ground is an electrically positive ground. Current is supplied through detector electrical resistance 42 up the output line 34 to terminal 158 for further connection to additional detector means.

In the detector means illustrated, sensor means are provided for positioning by duplicate wheels 74*a*, 74*b* (FIG. 2) or on opposite tower arms 77*a*, 76*b* as the physical arrangement permits. The sensors 160, 162 are magnetic induction switches which are normally closed. Resistances 164, 166 are high impedance resistors (e.g., 2 megohm) which in combination with resistance 168, 170 reflect virtually an open circuit as to a current path between ground line 46 and output line 34. Upon deroping, the magnetic switch 160 or 162 opens allowing capacitor 174, 176 to change sufficiently to fire thyristor 178, 180 and allow for a direct current path between ground 46 and output line 34 through bypass switch 182, 184, light emitting diode 186, 188 and thyristor 178, 180. As a result, all the resistance in the output line 34 subsequent in the circuit (downstream of contact 158) is shunted out.

The bypass switches 182, 184 are connected through a current regulating diode 190 to bypass conductor 192 which is connected at terminal 194 by a conductor to terminal 148 of FIG. 3, and at terminal 196 to additional detector means.

Also shown in FIG. 4 is circuit means for open-circuit location. A blocking diode 198 and current regulating diode 200 are connected between the ground line 46 and output line 34 to permit reverse current flow for open circuit location as more fully discussed hereinbefore. Diode 201 is provided to bypass resistor 42 to allow the current from a downstream detector to pass relatively unimpeded so that a properly predictable voltge drop can be made to occur across resistor 49 (FIG. 3). The voltage drop seen across resistor 49 is supplied to the meter 128 for read out. Also shown are surge suppressors 202 and 204, which are provided to protect the circuitry against the hazards of lightning since the detectors are positioned on elevated towers 78 in the outdoor environment.

It should be noted that detector devices such as that shown in FIG. 4 are located on the several towers of a chair lift system of the type illustrated in FIG. 2. At the last tower, the reference resistor 40 (FIG. 1) is connected across terminals comparable to terminals 158 and 206 in the detector means positioned on the tower. The detector devices are constructed as interchangeable units resulting in cost savings in assembly and maintenance.

In operation, it has been found that the cable 73 (FIG. 2) jumps or bounces slightly out of the wheel groove from time to time, especially when chairs are not carrying people. Slight jumping sometimes causes the magnetic switch 160, 162 to operate. The capacitance of capacitors 174, 176 is selected to produce a time delay in the firing of thyristors 178, 180 so that slight jumping or bouncing does not result in the generation of an invalid derope detection signal. That is, only an actual deroping will result in the firing of thyristor 178, 180 and cause a change in voltage at the output of the constant current generator 22.

In operation, a derope condition results in a change of the resistance in the circuit comprised of the detector means (FIG. 4) and reference resistor (not shown). This change is detected by the sensor trigger 60 via ground line conductors 98, 210, 212 and 214 and output line conductors 216 and 218. The sensor trigger 60 activates relay *k*1 from its normally energized condition to a de-energized condition. The resulting change in contact positions is set forth in Table I below. The result is the energization of the meter 128, which receives the output voltage of the constant current generator which the meter converts into a digital number that is visually displayed. Simultaneously, lamp L1 is lighted to indicate the existance of derope condition. Also, relay *k*5, which is normally energized, is de-energized causing normally closed *k*5 contacts 9–11 to open. That is, the tripping means 132 is tripped. The chair lift system is thus shut down. Also, *k*5 contacts 5–6 operate to energize an optional remote indicator lamp (not shown) connected at terminal 205.

It should be noted that activation *k*1 contacts 8–11 not only results in energization of lamp L1, but also energization of normally de-energized relay *k*6 to supply power to the meter 128. Further, it should be noted that *k*5 is normally energized. Thus, loss of power at terminals 90 and 92 will result in the de-energization of *k*5 and chair lift system shut down. Relay *k*5 may thus be regarded as a fail-safe relay.

The open-line detect trigger 124 detects the existence of an open-line voltage over ground conductors 98, 210, 212 and 214 and over output line conductors 216 and 220. Upon detection, relay *k*2, which is normally de-energized, is energized. Reference to Table I and the contact positions set forth therein, shows that the open-line indicate lamp L2 is energized and *k*5 de-energized. The chair lift system is thus shut down.

To locate an open-line upon the occurrance thereof, the open-line locating means 36 is operated. The locating means is push button switch S1, which activates relay *k*3. As shown in Table I, the change in the contacts of relay *k*3 and the opening of contact C of switch S1 result in the reversal of the current flow in output line 118 and ground line 98 by connecting the voltage regulator 30 to the output line 118 via dropping resistor 49. Contact B of switch S1 activates the meter 128 so that indication can be received and displayed.

Upon activation of a bypass switch 182, 184 (FIG. 4), the bypass detection circuit 66 detects a current flow at terminal 148 via conductor 224 energizing normally de-energized relay *k*4. As seen from the contact position of Table I, lamp L3 is energized to indicate the existence of a bypass condition. Further, the voltage drop across dropping resistor 226 is supplied to the meter 128 which, upon manual activation by a switch (not shown) supplying power to terminals 140 and 142, will indicate the location of the detector bypassed.

To reset a detector as illustrated in FIG. 4 for operation after detecting a derope condition, the entire system may simply be turned off and on again. In effect, any operation that interrupts the current flow through thyristor 178 will reset the detector and allow for reinitiation of chair lift system operation.

Table I

| Relay | Condition | Contact Position | | | | | |
|---|---|---|---|---|---|---|---|
| | | 1–3 | 1–4 | 5–6 | 6–7 | 8–11 | 9–11 |
| k-1 | de-energized | C | O | O | C | O | C |
| | energized | O | C | C | O | C | O |
| k-2 | de-energized | — | C | C | O | — | O |
| | energized | — | O | O | C | — | C |
| k-3 | de-energized | O | C | — | O | C | O |

Table I-continued

| Relay | Condition | Contact Position | | | | | |
|---|---|---|---|---|---|---|---|
| | energized | C | O | — | C | O | C |
| k-4 | de-energized | — | — | O | — | C | — |
| | energized | — | — | C | — | O | — |
| k-5 | de-energized | — | — | C | — | — | O |
| | energized | — | — | O | — | — | C |
| k-6 | de-energized | O | — | — | — | — | — |
| | energized | C | — | — | — | — | — |

O = Open
C = Closed

It should be noted that the activation of the relays above-described with the related passage of current and voltage signals thereby effected are regarded as detection signals. Those skilled in the art will recognize that other means may be used to produce detection signals which can be transmitted to effect similar results.

It is to be understood that the embodiments of the invention described herein are merely illustrative of the application of the principles of the invention. Reference herein to details of the illustrated embodiment is not intended to limit the scope of the claims which themselves set forth those features regarded as essential to the invention.

I claim:

1. Detection apparatus comprising:

a power supply;

a constant current generator conductively connected to said power supply to receive electrical energy therefrom and having an output for supplying constant current electrical energy;

an output line conductively connected to said output of said constant current generator;

a ground line conductively connected to said constant current generator;

a plurality of detector means each conductively connected to said output line and said ground line, each of said detector means including:

a detector electrical resistance connected in series circuit in said output line, sensor means conductively connected between said output line and said ground line, said sensor means being electrically nonconductive in the absence of external stimulus and becoming electrically conductive upon the incidence of external stimulus, and bypass means which operates to electrically interrupt the electrical connection of said sensor means between said output line and said ground line, said bypass means including means cooperatively associated therewith to detect the operation of said bypass means and signal said detector circuit of said operation;

a reference electrical resistance conductively connected between said output line and said ground return line;

a detector circuit conductively connected to said output of said constant current generator and said ground line to detect the electrical voltage present at said output of said constant current generator and to generate a detection signal reflective of said voltage;

operation means conductively connected to receive said detection signal and operate in relation thereto; and wherein said constant current generator supplies a constant electrical current at its output to said detector means and said reference electrical resistance resulting in the presence of a predictable voltage at the output of said constant current generator reflective of the total electrical resistance in the circuit of said output and said ground line so that upon the incidence of external stimulus the resulting electrical conduction of a sensor means causes a change in the total electrical resistance in circuit and a predictable change in the voltage at said output that is detected by said detector circuit which thereupon generates a detection signal that activates said operation means.

2. The apparatus of claim 1 wherein said bypass means is an electrical switch operable between a first position connecting said sensor means between said output line and said ground line and a second position connecting said ground line to said detection circuit via a conductor conductively connected to said switch and to said detection circuit and wherein said detection circuit has means to generate a detection signal reflective of the operation of said bypass switch.

3. The apparatus of claim 2 wherein said operation means includes indicator means which receives said detection signals to visually display the identity of an electrically conductive sensor means.

4. The apparatus of claim 3 wherein said detection circuit includes an open-line detection trigger to detect the existance of a predictable voltage at the output of said constant current generator reflecting the absence of a completed circuit conducting current between said output line and said ground return line.

5. The apparatus of claim 4, including open-circuit locating means conductively connected in said output line and said ground line operable to electrically convert said output line into an alternate ground return line and said ground line into an alternate output supply line, and wherein said constant current generator includes a voltage regulator conductively connected to a dropping resistor which is conductively connectable to said alternate output supply line, and wherein each said detector means includes circuit means which permits the flow of electrical current from said alternate output supply line to said alternate ground return line and which inhibits the flow of electrical current from said output line to said ground line so that upon the operation of said open-circuit locating means current flows from said alternate output supply line to said alternate ground return line so that a predictable voltage is generated across said dropping resistor reflective of the total electrical current in circuit and in turn the identity of the detector means farthest in electrical circuit from the output of said constant current generator through which electrical current passes and in turn the location of the detector means nearest an open-circuit condition in said output and ground line and said detection circuit detects said predictable voltage and generates a detection signal reflecting said voltage which is received by said operation means and in turn said indicator means to display the identity of said identified detector means.

6. The apparatus of claim 5 wherein said detector means includes circuit means conductively connected between said output and ground return lines to permit the flow of current from said alternate output supply line to said alternate ground return line, and wherein said sensor means and said circuit means are connected to said output line subsequent in electrical circuit to said detector electrical resistance and said reference resistance is connected subsequent in electrical circuit to said detector means.

7. Detection apparatus for use with a chair lift system having a plurality of cable support towers each of which has grooved rotatable cable wheels to support said cable while permitting cable movement, said apparatus comprising:

a power supply;

a constant current generator conductively connected to said power supply to receive electrical energy therefrom and having an output for supplying constant current electrical energy;

an output line conductively connected to said output of said constant current generator;

a ground line conductively connected to said constant current generator;

a plurality of detector means each positioned proximate said cable and cable wheels and conductively connected between said output line and said ground line each of said detector means including:

a detector electrical resistance connected in series circuit in said output line; and sensor means conductively connected to said output line and said ground line, said connection to said output line being subsequent in electrical circuit to said resistor, said sensor means being positioned proximate both said wheels and said cable and said sensor means being nonconductive when said cable is positioned in the groove of said wheels and becoming electrically conductive upon the deroping of said cable;

a reference electrical resistance conductively connected between said output line and said ground return line subsequent in electrical circuit to said detector means;

a detector circuit conductively connected to said output of said constant current generator and said ground line to detect the electrical voltage at the output of said constant current generator and to generate detection signals reflective of said voltage;

indicator means conductively connected to said power supply to receive electrical power therefrom and to said detector means to receive said detection signals to indicate the existence of said deroping;

trip means connected to said detector circuit to receive said detection signals which stops said chair lift system upon the occurrence of said deroping; and wherein said constant current generator supplies a constant electrical current at its output to said detector means and said reference electrical resistance resulting in the presence of a predictable voltage at the output of said constant current generator reflective of the total electricl resistance in said circuit of output line and said ground line so that upon the occurrence of a deroping of said cable the resulting electrical conduction of a sensor means causes a change in the total electrical resistance in circuit and a predictable change in the voltage at said output of said constant current generator indicative of the location of the detector means detecting said derope condition, said detector circuit detecting said predictable voltage change and transmitting said detection signals reflective of said change to said indicator means to indicate the presence and location of said derope condition and to said trip means to stop said chair lift system.

8. The apparatus of claim 7 wherein each said detector means has bypass means which operates to electrically interrupt the electrical connection of said sensor means between said output line and said ground line.

9. The apparatus of claim 2 including means cooperatively associated with said bypass means to detect the operation of said bypass means and signal said detector circuit of said operation.

10. The apparatus of claim 9 wherein said bypass means is an electrical switch operable between a first position connecting said sensor means between said output line and said ground line and a second position connecting said ground line to said detection circuit via a conductor conductively connected to said switch and to said detection circuit and wherein said detection circuit has means to generate a detection signal reflective of the operation of said bypass switch.

11. The apparatus of claim 10 wherein said indicator means includes visual alarm means to display a visual signal upon the occurrence of a derope condition and visual display means to visually display the location of the detector means detecting the derope condition.

12. The apparatus of claim 11 wherein said detection circuit includes an open-line detection trigger to detect the existance of a predictable voltage at the output of said constant current generator reflecting the absence of a completed circuit conducting current between said output and said ground return line.

13. The apparatus of claim 12, including open-circuit locating means conductively connected in said output line and said ground line operable to electrically convert said output line into an alternate ground return line and said ground line into an alternate output supply line, and wherein said constant current generator includes a voltage regulator conductively connected to a dropping resistor which is conductively connected to said alternate output supply line, and wherein each said detector means includes circuit means which permits the flow of electrical current from said alternate output supply line to said alternate ground return line and which inhibits the flow of electrical current from said output line to said ground line so that upon the operation of said open-circuit locating means current flows from said alternate output supply line to said alternate ground return line so that a predictable voltage is generated across said dropping resistor reflective of the total electrical current in circuit and in turn the identity of the detector means farthest in electrical circuit from the output of said constant current generator through which electrical current passes and in turn the location of the detector means nearest an open-circuit condition in said output and ground line and said detection circuit detects said predictable voltage and generates a detection signal reflecting said voltage which is received by said operation means and in turn said indicator means to display the identity of said identified detector means.

* * * * *

UNITED STATES PATENT AND TRADEMARK OFFICE

CERTIFICATE OF CORRECTION

PATENT NO. : 3,991,413
DATED : November 9, 1976
INVENTOR(S) : Philip H. Berger

It is certified that error appears in the above-identified patent and that said Letters Patent are hereby corrected as shown below:

Col. 1, line 21, change "circuiry" to ---circuitry---;

Col. 2, line 20, change "inclined" to ---included---;

Col. 4, line 14, change "relationshipj" to ---relationship---;

Col. 4, line 51, change "resistance" to ---resistances---;

Col. 5, line 46, change "110" to ---22---;

Col. 6, line 11, change "77a" to ---76a---;

Col. 6, line 19, change "change" to ---charge---;

Col. 10, line 58, change "electricl" to ---electrical---.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*